United States Patent [19]

Kirkland

[11] Patent Number: 4,999,821

[45] Date of Patent: Mar. 12, 1991

[54] TRUCK DRIVER'S WAKE-UP DEVICE

[76] Inventor: Ephraim A. Kirkland, Rte. 1, Box 1375, Afton, Okla. 74331

[21] Appl. No.: 428,781

[22] Filed: Oct. 30, 1989

[51] Int. Cl.[5] ..... G04B 47/00

[52] U.S. Cl. ..... 368/12; 368/258; 368/257

[58] Field of Search ..... 368/12, 258, 262, 274, 368/10, 257

[56] References Cited

U.S. PATENT DOCUMENTS

| | | | |
|---|---|---|---|
| 351,746 | 11/1886 | Derrick et al. | 368/258 |
| 546,016 | 9/1895 | Kist | 368/258 |
| 1,886,358 | 11/1932 | Salinger | 368/274 |
| 3,361,973 | 1/1968 | Wysong | 368/12 |
| 3,678,679 | 7/1972 | Lee et al. | 368/262 |
| 4,282,596 | 8/1981 | Siefert et al. | 368/262 |
| 4,431,312 | 2/1984 | Chambers et al. | 368/10 |

*Primary Examiner*—Bernard Roskoski

*Attorney, Agent, or Firm*—William S. Dorman

[57] ABSTRACT

A truck driver's wake-up device comprising a conventional mechanical alarm clock constructed from metal parts which are electrically conductive and having therein an alarm trip which moves in a predetermined path when an internal alarm system in the clock is actuated, a support for mounting the clock thereon, a high output buzzer capable of producing a loud alarm mounted on the support, the buzzer having first and second input leads for actuating the alarm when an input voltage of 8–16 volts DC is impsoed across the leads, a standard automotive cigarette lighter adapter having first and second outlet leads for providing approximately 12 volts DC output when the adapter is inserted into a standard cigarette lighter socket, the first output lead from the adapter being grounded to the clock, the second output lead from the adapter being connected to the second input lead to the buzzer, a non-conductive insulator plate connected to the clock adjacent the alarm trip, an electrically conductive spade connector attached to the insulator plate and in the path of movement of the alarm trip but out of electrical contact with the metal parts of the clock mechanism, the first input lead from the buzzer being connected to the spade connector whereby, when the internal alarm system for the clock is actuated, the alarm trip will contact the spade connector to complete the electrical circuit to the buzzer.

2 Claims, 2 Drawing Sheets

TRUCK DRIVER'S WAKE-UP DEVICE

BACKGROUND OF THE INVENTION

1. Field of the Invention

THe present invention relates to a device for waking up truck drivers. More particularly, the present invention relates to an extremely loud alarm which is actuated through an electrical circuit to the battery in response to an indication from a conventional alarm clock for insuring that the truck driver will be awakened at a predetermined time.

2. The Prior Art

Many diesel trucks are equipped with sleepers for the convenience of the truck driver. However, it oftentimes occurs that the driver will leave the truck motor running to operate the air conditioner in hot weather, or, in the case of a refrigerated trailer, the mechanism for operating the refrigeration unit will be running constantly. In either case, the noise created by these machines will prevent the truck driver from hearing a conventional alarm from a conventional alarm clock. Furthermore, many truck drivers become so used to the constant noise created by the diesel engine while driving that they do not respond to the low level of noise created by a conventional alarm clock.

Therefore, it is an object of the present invention to provide a wake-up device which will create an extremely loud alarm to wake up a truck driver in a sure and efficient manner.

A preliminary patentability search was conducted on the present invention and the following listed U.S. Pat. Nos. were uncovered in that search:

| | | |
|---|---|---|
| Tanglin | 1,529,852 | March 17, 1925 |
| Wiseley | 2,517,368 | August 1, 1950 |
| Willis | 4,144,706 | March 20,1979 |
| Stephens | 4,379,639 | April 12,1983 |

Willis, U.S. Pat. No. 4,144,706, and Stephens, U.S. Pat. No. 4,379,639, both relate to alarm watches with remote sonic generators or amplifiers.

Wisely, U.S. Pat. No. 2,517,368, shows an alarm clock capable of actuating a hearing aid type speaker 10 in response to the movement of the escape mechanism of a clock through a lever arm and battery circuit. The speaker 10 can be worn adjacent or within the external ear of a deaf person who is utilizing this device.

Tanglin, U.S. Pat. No. 1,529,852, shows an alarm watch supported in a frame 5, a battery 7, an electric bell 8, a wiring circuit from the battery to the bell, and wires leading to the watch, including internal wires 19 and 20. The wire 20 is described as insulated; however, the inner end 19 of the wire 20 is described as being always in contact with the sleeve 18.

SUMMARY OF THE INVENTION

A device for waking up truck drivers comprising a conventional wind-up travel alarm clock which is constructed from metal parts which are electrically conductive. The mechanical clock is already provided with an internal alarm system which includes an alarm trip which moves in a predetermined path when the internal alarm system is actuated. The clock is mounted on a support upon which a high output buzzer is also mounted. The buzzer is capable of producing a loud alarm. The buzzer is provided with a pair of input leads which, when connected to an input voltage of 8–16 volts DC will actuate the alarm. A standard automotive cigarette lighter adapter provides the source of power for the buzzer by way of the alarm trip in the clock. That is, the adapter has a pair of leads which will produce a voltage of approximately 12 volts DC when the adapter is inserted into a cigarette lighter socket. One lead from the adapter is connected to one of the leads to the buzzer. Of the remaining two leads, one is grounded to the clock. The remaining unconnected lead is connected to a spade connector which is disposed adjacent the alarm trip in the clock and in the path of movement of the alarm trip. The spade connector is electrically insulated from the clock by means of an insulator plate which is sandwiched between the spade connector and the clock. When the internal alarm system of the clock is actuated, the alarm trip will contact the spade connector to complete the electrical circuit to the buzzer and the buzzer will produce a loud alarm.

DETAILED DESCRIPTION OF THE PREFERRED EMBODIMENTS

Figure 1:
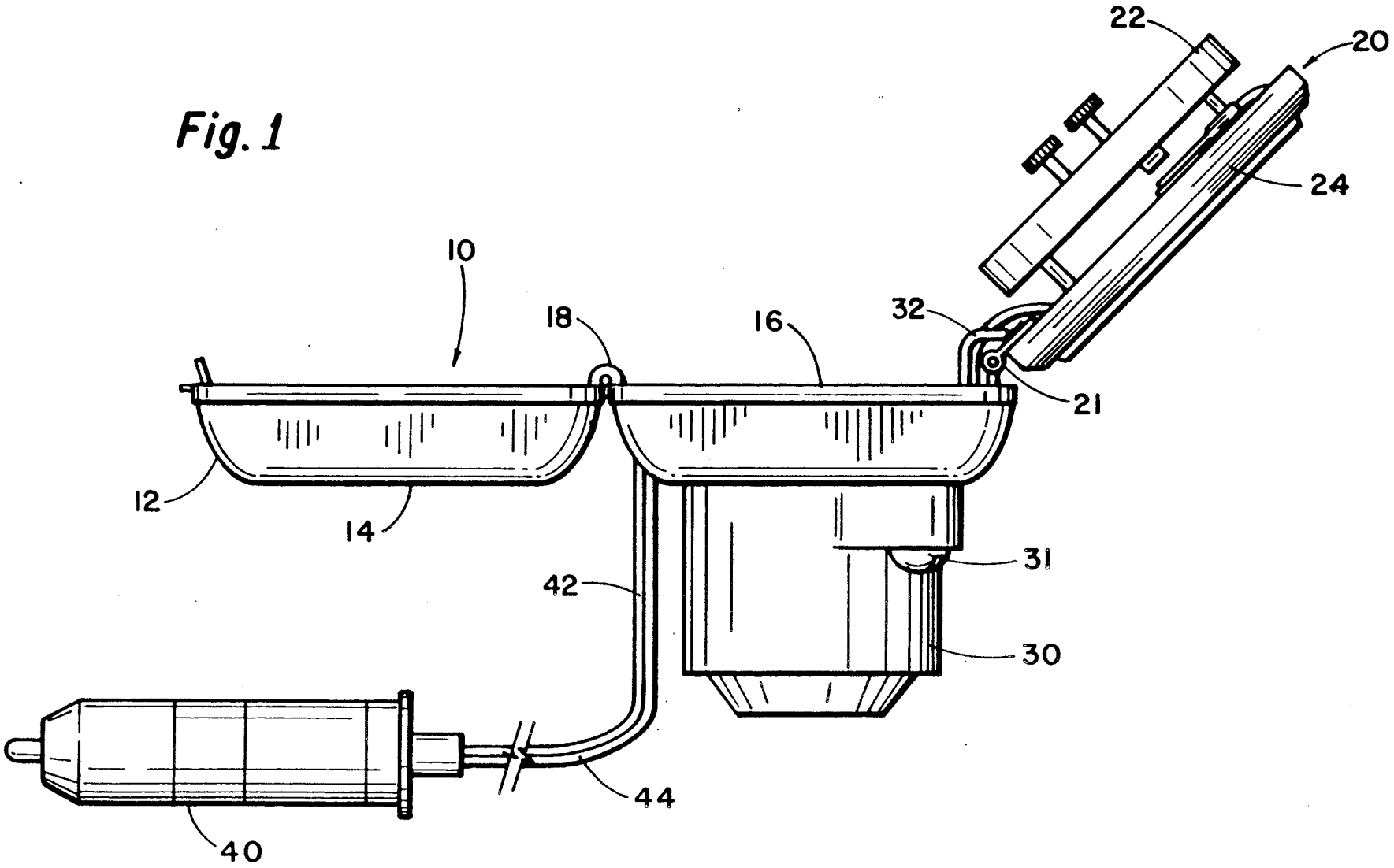
FIG. 1 is a semi-diagramatic view of the major components which make up the present invention.
Figure 2:
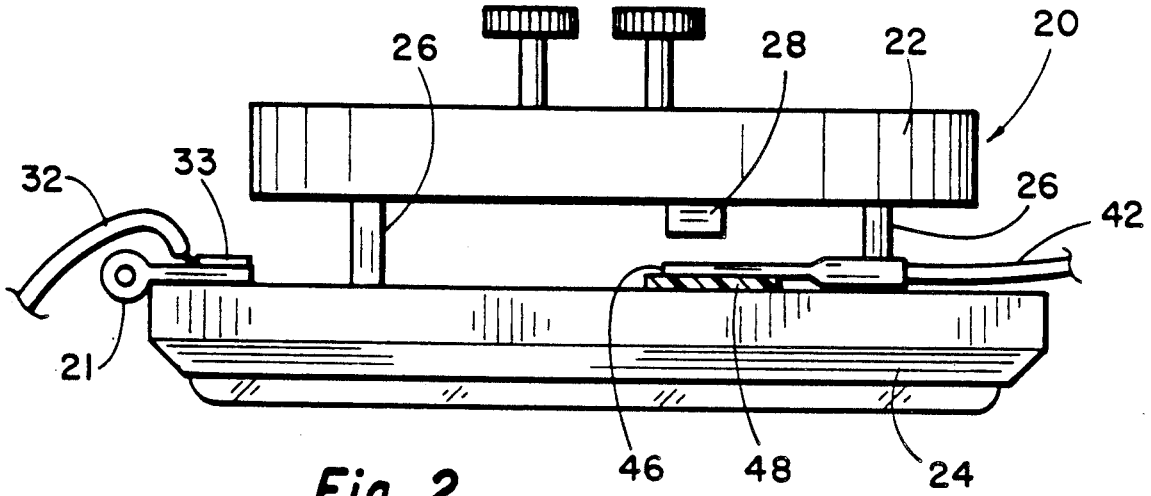
FIG. 2 is a semi-diagramatic view, on an enlarged scale, of the electrical connections to the clock mechanism shown in FIG. 1.

Referring to the drawings in detail, FIG. 1 shows a truck driver's wake-up device 10 comprising a cover or casing 12 which includes two foldable portions or sections 14 and 16 connected together by a hinge 18. Within the section 16, a mechanical clock 20 is pivotally mounted by means of a hinge 21. The clock itself is a wind-up clock which is sold by Eastern Time Limited under the name "Equity". The clock is purported to be covered by U.S. Pat. No. 3,678,679. The details of the clock are considered to be conventional and will not be shown or discussed in detail except to note that the clock has a "work" section 22 and a face section 24 which are spaced apart by means of rods 26. The clock is made of metal parts which are electrically conductive. The clock is also provided with an alarm trip 28 which drops downwardly when the internal alarm system for the clock is actuated. This alarm trip 28 will be utilized in the present invention in a manner to be described below.

A high output alarm device or buzzer 30 is attached to the outside of the cover portion 16 by means of a pair of screws 31 (only one of which is shown). This alarm device is sold by Radio Shack, a division of Tandy Corporation, under the name "Piezo Buzzer", Catalog No. 273–070. The buzzer 30 operates on a voltage of 8–16 VDC, has a current consumption of 130 mA. at 12 VDC with a sound pressure level of 100 dB. It produces a 2-tone warble and has a resonant frequency of 2500 Hz.

Figure 3:
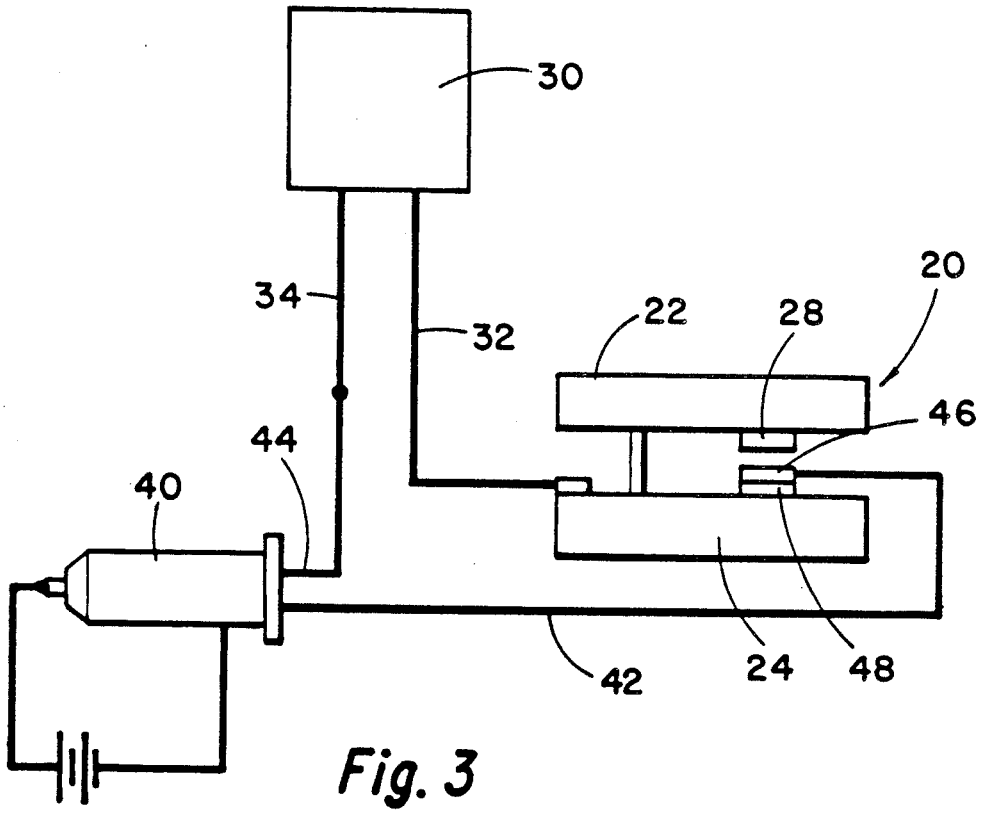
FIG. 3 is an electrical circuit diagram.

The details of the "Piezo Buzzer" 30 will not be further described except to note that this device is provided with two input leads, only one of which is shown in FIG. 1. Lead 32 from the buzzer 30 is grounded to the clock 20 at 33; the other lead 34 (see FIG. 3) from the device 30 is connected to one of the leads from the cigarette lighter adapter later to be described.

In order to provide a source of power for the buzzer 30, the present invention provides a standard automotive cigarette lighter adapter 40 which is adapted to be inserted into a standard cigarette lighter socket (not shown) on a standard automotive vehicle so as to connect with a 12 volt battery of the automobile. The cigarette lighter adapter 40 is provided with the necessary connections (not shown) for connecting with the output voltage in the standard socket (not shown) referred to above. The cigarette lighter adapter 40 is provided with two outlet leads 42 and 44 which provide a 12 VDC source of power for the buzzer. The lead 44 is connected directly to the input lead 34 for the buzzer 30. The other lead 42 from the adapter 40 passes into the interior of the section 16 and to the clock 20 where it connects with a spade connector 46. The spade connector 46 is mounted on an insulator plate 48 which isolates the lead 42 and the spade connector electrically from the clock 20. Both the spade connector 46 and the insulator plate 48 are positioned beneath the alarm trip 28. The spade connector 46, furthermore, is in the path of movement of the alarm trip 28 and will be contacted by the alarm trip when the latter drops downwardly after the internal alarm system of the clock is actuated, as described above. Downward movement of the alarm trip 28 will "ground" the lead 42 to the clock 20 and the circuit to the buzzer is thereby completed.

Whereas the input lead 32 from the buzzer is shown grounded as at 33, and the output lead 42 from the adapter 40 is shown as being connected to the spade connector 46, these connectors could be reversed; that is, the lead 42 could be grounded at 33 and the lead 32 could be connected to the spade connector 46.

Returning now to a consideration of FIG. 1, the clock 20 can be pivoted around the hinge 21 so that it is received within the section 16. Thereafter, the section 14 can be pivoted around the hinge 18 so as to close with respect to the section 16. A clasp (not shown) or other device can be used to hold sections 14 and 16 together.

In its normal condition of use, the cover section 14 would be opened with respect to section 16 as shown in FIG. 1. Thereafter, with the clock 20 pivoted outwardly as shown in FIG. 1, section 16 is moved counterclockwise with respect to the section 14 while simultaneously moving the outer end of the clock 20 so as to be received in the forward inside edge of section 14. At this time, the front face 24 of the clock will be almost vertical and will be visible so as to show the time. Prior to tucking the outer end of the clock 20 into the forward edge of the cover 16, the appropriate knob is turned to the desired wake-up tie. The driver should also see that the clock is properly wound. Thereafter, the adapter 40 is inserted into the socket in the truck which has been provided for the conventional cigarette lighter. The truck driver can now retire to the sleeper portion of the truck with a confident feeling that the buzzer 30 will produce a sufficiently loud alarm that he will be awakened from even the soundest sleep.

Whereas the present invention has been described in particular relation to the drawings attached hereto, it should be understood that other and further modifications, apart from those shown and suggested herein, may be made within the spirit and scope of this invention.

What is claimed is:

1. A truck driver's wake-up device comprising a conventional mechanical alarm clock constructed from metal parts which are electrically conductive and having therein an alarm trip which moves in a predetermined rectilinear path when an internal alarm system in the clock is actuated, a support for mounting the clock thereon, a high output buzzer capable of producing a loud alarm mounted on the support, the buzzer having first and second input leads for actuating the alarm when an input voltage of 8–16 volts DC is imposed across the leads, a standard automotive cigarette lighter adapter having first and second outlet leads for providing approximately 12 volts DC output when the adapter is inserted into a standard cigarette lighter socket, the first output lead from the adapter being grounded to the clock, the second output lead from the adapter being connected to the second input lead to the buzzer, a non-conductive insulator plate connected to the clock adjacent the alarm trip, an electrically conductive spade connector attached to the insulator plate and in the path of movement of the alarm trip but out of electrical contact with the metal parts of the clock mechanism, the first input lead to the buzzer being connected to the spade connector whereby, when the internal alarm system for the clock is actuated, the alarm trip will contact the spade connector to complete the electrical circuit to the buzzer.

2. A truck driver's wake-up device comprising a conventional mechanical alarm clock constructed from metal parts which are electrically conductive and having therein an alarm trip which moves in a predetermined path when an internal alarm system in the clock is actuated, a support for mounting the clock thereon, a high output buzzer capable of producing a loud alarm mounted on the support, the buzzer having first and second input leads for actuating the alarm when an input voltage of 8–16 volts DC is imposed across the leads, a standard automotive cigarette lighter adapter having first and second outlet leads for providing approximately 12 volts DC output when the adapter is inserted into a standard cigarette lighter socket, the first input lead to the buzzer being grounded to the clock, the second output lead from the adapter being connected to the second input lead to the buzzer, a non-conductive insulator plate connected to the clock adjacent the alarm trip, an electrically conductive spade connector attached to the insulator plate and in the path of movement of the alarm trip but out of electrical contact with the metal parts of the clock mechanism, the first output lead to the adapter being connected to the spade connector whereby, when the internal alarm system for the clock is actuated, the alarm trip will contact the spade connector to complete the electrical circuit to the buzzer.

* * * * *